United States Patent [19]

McCaslin

[11] 4,333,258

[45] Jun. 8, 1982

[54] ELECTRONIC TOY

[76] Inventor: Robert E. McCaslin, 1227 Coldwater Canyon, Beverly Hills, Calif. 90210

[21] Appl. No.: 246,557

[22] Filed: Mar. 23, 1981

[51] Int. Cl.[3] ..... A63H 3/52; A63H 33/26

[52] U.S. Cl. ..... 46/14; 46/232; 340/384 E

[58] Field of Search ..... 46/232, 14, 227; 273/138 A; 340/384 E; 434/169

[56] References Cited

U.S. PATENT DOCUMENTS

| | | | |
|---|---|---|---|
| 3,120,717 | 2/1964 | Glass et al. | 46/14 |
| 3,483,634 | 12/1969 | Staples et al. | 46/232 X |
| 3,798,833 | 3/1974 | Campbell | 46/232 X |
| 4,155,196 | 5/1979 | Bollinger et al. | 46/232 |

*Primary Examiner*—Gene Mancene
*Assistant Examiner*—Mickey Yu
*Attorney, Agent, or Firm*—John L. McGannon

[57] ABSTRACT

A toy having electronic circuitry for generating different sounds simulating sounds resulting from certain activities such as cooking or running water. The toy is in the form of a toy stove provided with a housing having a simulated water delivery tap, a sink below the tap, and a simulated burner section for supporting one or more toy utensils in locations simulating the heating of the utensils. The electronic circuit is carried by the housing beneath the burner section and includes a white noise generator, an amplifier, and a speaker for providing audible sounds corresponding to the output signals of the white noise generator. A sound effects oscillator is coupled with the white noise generator for changing the sounds produced by the white noise generator as a function of the type of utensil on the burner section. Each utensil has one or more magnets thereon for closing reed switches forming parts of the sound effects oscillator, the reed switches being mounted below the burner parts of the burner section at predetermined locations for selective actuation by the magnets when the utensils are on the burner sections. The various sounds that can be produced are sounds simulating water flowing through the tap, a tea kettle whistle, the perking of coffee in a coffee pot, and the sizzle of meat on a frying pan. Other sounds can be produced by selectively changing the output frequency of the sound effects oscillator.

8 Claims, 5 Drawing Figures

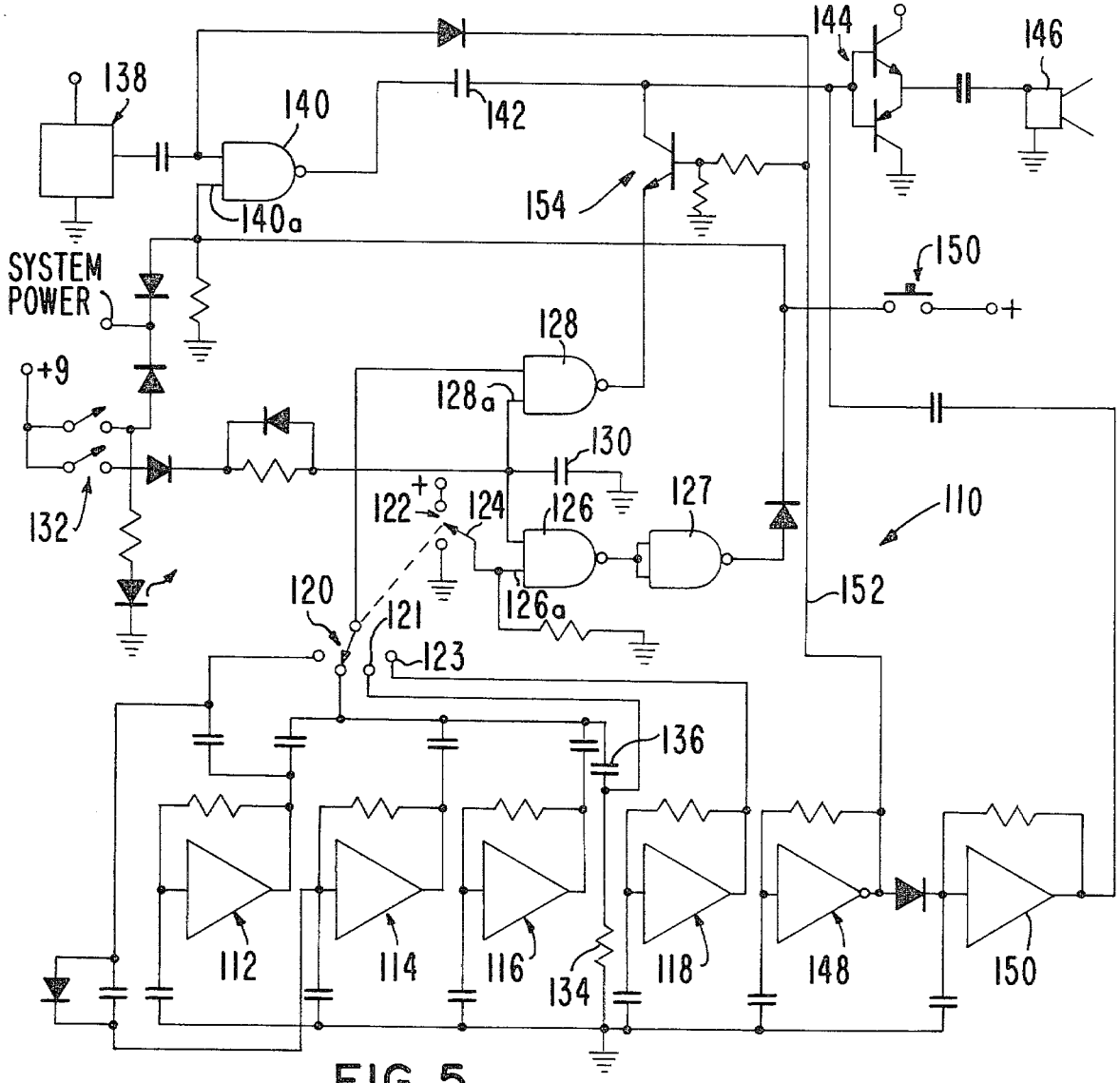
FIG. 5
FIG. 3
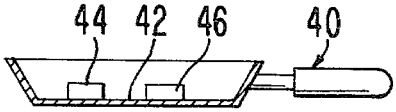
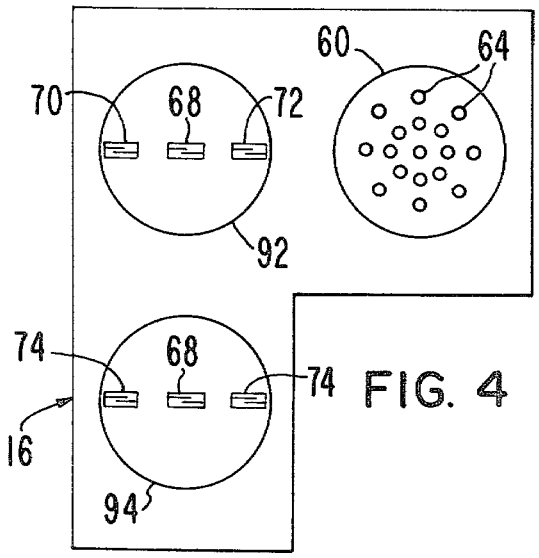
FIG. 4

ELECTRONIC TOY

This invention relates to improvement in toys of the type which emit sounds and, more particularly, to a toy having electronic circuitry including a speaker which emits sounds simulating different sounds found in everyday life, such as cooking and other kitchen-type sounds.

BACKGROUND OF THE INVENTION

Toys have been made in the past for causing sounds to be made which simulate certain real-life sounds. For the most part, these toys produce only single sounds and these sounds do not completely duplicate the sounds which are desired. Attempts have been made to produce multiple sounds of different frequencies from toys, but none have been too successful especially in connection with the generating of sounds simulating cooking and other kitchen-like sounds, such as the sound of a flow of water from a water tap into a sink, the whistle of a tea kettle, the perking of a coffee pot and the sizzle of meat on a frying pan. Because of these drawbacks, a need has arisen for a toy having means operable simulate a number of different these sounds in a simple manner so that the toy can be operated by a child having only the knowledge of how to operate easy-to-use on-off switches.

SUMMARY OF THE INVENTION

The present invention satisfies the aforesaid need by providing a toy having electronic circuitry therein for simulating any one of a number of different everyday sounds, such as cooking or kitchen-like sounds. While the teachings of the present invention can be applied to toys for simulating a wide range of different sounds, the invention will hereinafter be described with respect to a toy stove.

The circuitry includes a white noise generator and a speaker for causing audible sounds to be produced as a function of the output signals of the generator. The electronic circuitry is carried in a housing shaped like a stove and having a simulated burner section with one or more burner parts thereon for supporting utensils such as a teapot, a coffee pot, a sauce pan and a frying pan. The burner section of the toy stove is provided with switches which are closed when utensils are placed over the burner parts. For purposes of illustration, the utensils have magnets which cause the closing of reed switches on the burner section which, in turn, couple a sound effects oscillator to the white noise generator. When this occurs, the output signal of the sound effects oscillator mixes with the signal of the white noise generator to cause a distinstive sound to be emitted by the speaker. These sounds can be changed by selective actuation of the reed switches, such switches being at the input of the sounds effects oscillator for coupling, for instance, different capacitors thereto. In this way, the frequency of the output signal from the oscillator can be changed so that such output signal, when mixed with the signal of the white noise, generator, can be amplified and directed to the speaker to cause sounds simulating a specific cooking or other sound emanating from a conventional cooking stove, such as a tea kettle whistle, perking of coffee or the sizzle of meat on a frying pan. The sound of water flowing out of a tap and into a sink can also be simulated by actuation of one or more switches when no utensils are on the burner section.

The primary object of this invention is to provide a toy, such as a toy stove, having electronic circuitry associated therewith for producing sounds, such as cooking or other kitchen-like sounds, as a result of the simulated use of the toy with different objects, such as kettles, pots, pans and the like, the sounds being produced by the mere placement of an object on the toy and the actuation of one or more easy-to-use switches, all of which operates to provide enjoyment for children and to stimulate their interests in sounds as they are actually produced by actual appliances simulated by the toy.

Other objects of this invention will become apparent as the following specification progresses, reference being had the accompanying drawings for an illustration of the invention.

IN THE DRAWING

FIG. 3 is a vertical section through a toy frying pan adapted to be used with the toy stove with FIG. 1;

FIG. 4 is top plan view of the burner section of the stove with the top cover plate removed to illustrate a number of switches and a speaker mounted in the housing of the stove; and FIG. 5 is a schematic diagram of a second embodiment of the electronic circuitry used with the toy stove.

Figure 1:
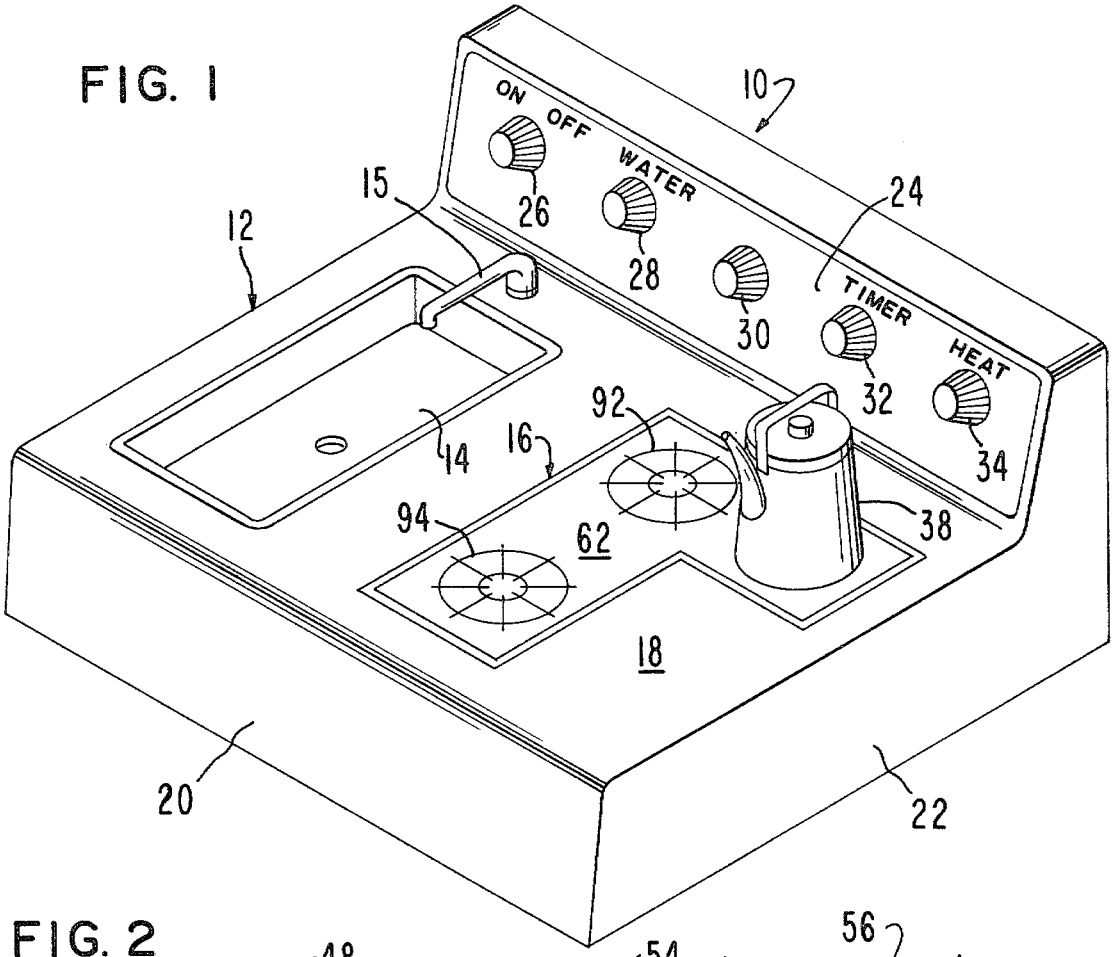
FIG. 1 is a perspective view of the toy of the present invention in the form of a toy stove.

The electronic toy of the present invention is broadly denoted by the numberial 10 and, for purpose of illustration, is in the form of a toy stove having a stove housing 12 provided with a sink 14 below a simulated water tap 15 and a simulated burner section 16 mounted on the upper surface 18 of housing 12. The housing has sides 20 and 22 for positioning surface 18 above a support, such as a table top or the like. The housing also has an upright panel 24 provided with a number of push button switches 26, 28, 30 and 32 and a knob 34 mounted thereon. The switches are coupled to an electronic circuit mounted in any suitable manner in housing 12 below surface 18. A first embodiment of the circuit is denoted by the numeral 36 and is shown in FIG. 2.

A number of toy objects, such as cooking utensils, are provided with toy stove 10. For instance, the utensils could include a tea pot, a coffee pot, a sauce pan and a frying pan. For purposes of illustration only, a coffee pot 38 is shown on burner section 16 of FIG. 1. Each utensil is provided with magnetic means thereon, such as a pair of magnets. For instance, a frying pan 40 shown in FIG. 3 has a bottom surface 42 provided with a pair of permanent magnets 44 and 46 thereon. These magnets are strategically placed on bottom 42 to actuate certain switches, such as reed switches, forming parts of circuitry 36 when frying pan 40 or any other utensil is placed on burner section 16.

Sink 14 is below tap 15 to receive a simulated water flow therefrom. Actually, no water flows out of tap 15 but certain sounds are produced by circuit 36 which simulates the sound of a flow of water out of tap 15.

Figure 2:
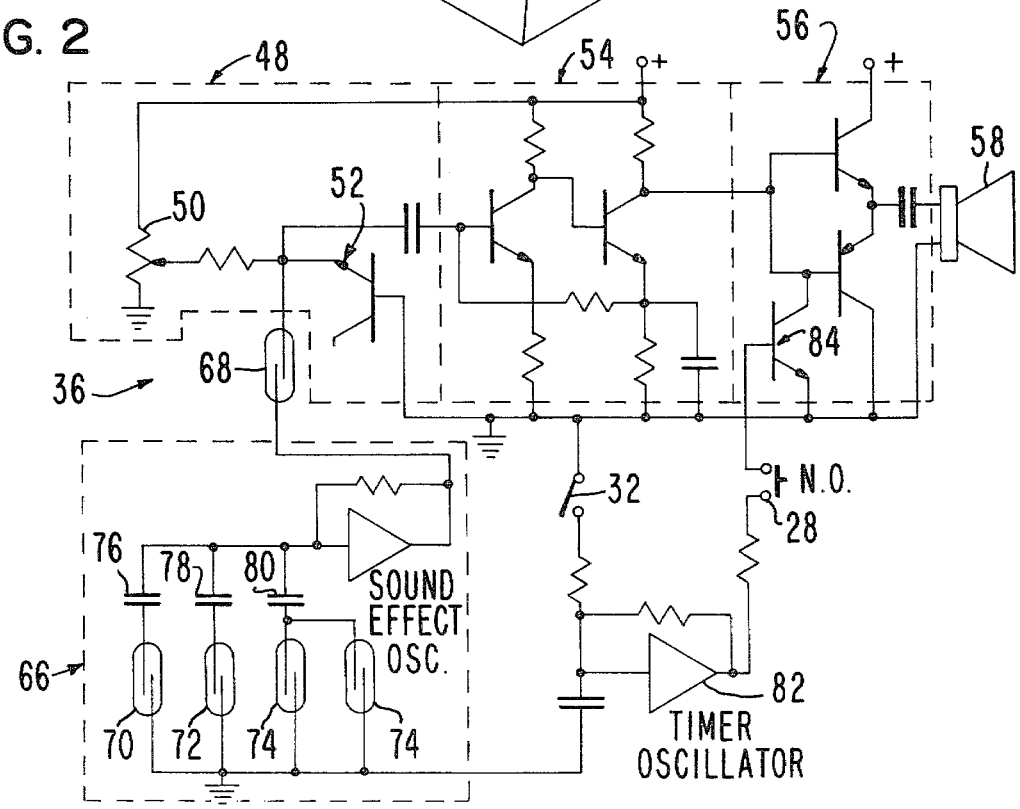
FIG. 2 is a schematic diagram of one embodiment of the electronic circuitry used with the toy stove.

Circuit 36, shown in FIG. 2, includes a white noise generator 48 having a variable potentiometer 50 coupled with transistor 52. The output of generator 48 is coupled to the input of an amplifier 54 whose output is coupled to a power amplifier 56 which drives a speaker 58. The speaker is typically mounted in a burner part 60 (FIG. 4) of burner section 16, the speaker being below the upper surface 62 of burner section 16 and the burner part having holes 64 through which sound passes.

A sound effects oscillator 66 is coupled through a reed switch 68 to white noise generator 48 at the emitter of transistor 52. Oscillator 66 has reed switches 70, 72 and 74 in parallel with each other at the input of the oscillator for coupling specific capacitors 76, 78 and 80 to the input of the oscillator. Thus, by selectively actuating the reed switches, different sound effects can be achieved, the output of the oscillator 66 being mixed with the output of generator 48 to provide a specific sound depending upon the particular arrangement of reed switches that are actuated.

A timer oscillator 82 is coupled to the gate of a transistor 84 forming part of power amplifer 56. Push button switch 32 on panel 24 actuates the timer along with a normally open push button switch 28 also on panel 24 and coupled between oscillator 82 and the gate of transistor 84.

Reed switches 68, 70, 72 and 74 are coupled below surface 62 at locations shown in FIG. 4. Thus, these reed switches are actuated when a specific utensil is placed on the burner parts 92 and 94. For instance, if frying pan 40 shown in FIG. 3 is placed on burner section 92, magnets 44 and 46 will actuate reed switches 70 and 68, respectively. Similarly, another utensil placed on burner part 94 may actuate reed switches 68 and 74. A second reed switch 68 can be used in parallel with the one shown in FIG. 2 so that both reed switches 68 can be at different burner parts 92 and 94. The timer oscillator operates to delay the generation of sounds until a predetermined interval after a utensil has been placed on a burner part.

In operation, after the on-off switch 26 is actuated to provide electrical power to circuit 36, a utensil can be placed on a burner part of burner section 16 to get a specific output sound. When there are no utensils on the burner section and when switch 28 is pressed, the white noise from generator 48 is amplified, after a short interval determined by time oscillator 82, through amplifiers 54 and 56 but is not mixed with the output of sound effect oscillator 66. When this occurs, the sound output at the speaker 58 appears as a hiss which sounds like water flowing out of tap 48 into sink 14.

When a utensil having a pair of magnets thereon in the manner shown in FIG. 3 is placed on a burner part 92 or 94, a particular sound is heard through the speaker. For instance, when the utensil is placed on burner part 92 and reed switches 68 and 70 are actuated, this causes these reed switches to close and to allow the output of oscillator 66 to be mixed with the output of the white noise generator 48. As a result, a 0.4 Hz signal is mixed with the white noise to produce a popping or a fast perking sound. When, for instance, reed switches 68 and 72 are closed, a 0.4 Hz signal is mixed with a white noise to produce a coffee perking sound. A tea whistle is produced when the combination of reed switches 68 and 74 are closed. By placing speaker 58 directly below burner part 60, this muffles the sound from the speaker so that the white noise emanating therefrom when frying pan 40 is on a particular burner part and produces a sizzle sound. By adjusting potentiometer 50 by rotating knob 34 on panel 24, the sizzle sounds can be changed to simulate the turning up or turning down of the heat applied to the utensil on the burner part.

Other sounds can be caused to be generated by the operation of circuitry 36. For instance, other switch-actuated capacitors for the input of sound effects oscillator 66 can be provided and the output of the oscillator, when mixed with white noise from generator 48 can produce other sounds such as the whirring of a blender, the popping of pop corn, and the grinding of a garbage disposal unit.

Another embodiment of the electronic circuit of the present invention is shown in FIG. 5 and denoted by the numeral 110. Circuit 110 has four oscillators 112, 114, 116 and 118 which are coupled to a rotary switch 120 and provide different output signals simulating different sounds. Switch 120 is ganged with a two-position switch 122 whose common terminal 124 is connected to the input of a gate 126. The other input of gate 126 is coupled to the input of a gate 128 and to a capacitor 130, which, in turn, is connected through a switch 132 having parallel reed switches similar to the reed switches shown in FIG. 4. An RC network including a resistor 134 and a capacitor 136 is across oscillator 116 as shown in FIG. 5.

A white noise generator 138 has its output coupled to an input of a gate 140 whose other input is coupled to reed switch 132. The output of gate 140 is coupled to a capacitor 142 to the input of a push-pull amplifier 144 which drives a speaker 146. Another pair of operators 148 and 150 are coupled by a lead 152 to the base of a transistor 154 and to another input of gate 140. White noise generator 138 can be of any suitable construction, such as a 5837 integrated circuit chip.

In use, circuit 110 is actuated when a pot or pan is placed on a burner of a stove, such as burner 92 (FIG. 4). The magnet carried by the product actuates one of the two parallel reed switches 132 to cause capacitor 130 to commence charging. After about 4 to 6 secs., the voltage at the input **128*a* of gate 128 is high enough to turn gate 128 on. When this occurs, the sound dialed in by rotary switch 120 is amplified by gate 128 and passed through transistor 154 to amplifier 144 which amplifies the signal and applies it to speaker 146**, resulting in a specific sound being heard.

Oscillator 148 is actuated when capacitor 130 commences to charge. Oscillator 148 is a low frequency oscillator (having an output signal of about one cycle every 24 seconds). When oscillator 148 commences to operate, its output is high, keeping transistor 154 in the on state, allowing sound effects signals to pass through to amplifier 144 and speaker 146. After about 12 seconds, oscillator 148 switches to the low state, turning off transistor 154 and causing oscillator 150 to be actuated. Oscillator 150 produces a signal which is applied to amplifier 144 to provide a low frequency buzz which simulates a low frequency buzzer being actuated. This signals that the food in the pot on the burner has finished cooking.

Since the various sound effects are created by oscillators 112, 114, 116, and 118, these oscillators can be selected so that their output signals represents different cooking sounds. For instance, the output signals of oscillators 112, 114, and 116 can represents popcorn sounds oscillating at different frequencies, such as to give random popping sounds. The RC network represented by resistance 134 and capacitor 136 filters most of the popping noise until only a few intermittent pops are heard.

When switch 120 is coupled to terminals 121 and 123, the output signals can represent a frying pan in operation or a whistle or tea kettle. When so positioned, switch 120 causes switch 122 to apply a positive voltage terminal **126*a* of gate 126 whose output signal is inverted by a gate 127, causing a positive voltage at the input 140***a* of gate 140. When terminal 140*a* of gate 140 is high, then gate 140 is turned on, which passes the white noise from generator 138 to amplifier 144. This white noise is mixed with the intermittent popping sounds to produce a frying sound. The whistle of a tea kettle is simulated in the same way except that oscillator 118 (high frequency output tone) is mixed with the white noise from generator 138 to produce a realistic tea whistle sound.

A water switch 150, a normally open switch, is connected directly to the positive side of the power source of circuit 110 so that the simulated flow of water can be heard without placing a pot or pan or any of the burners of the stove. When this switch is closed, it applies a positive voltage to input 140*a* of gate 140 and this allows only the white noise from the white noise generator to be heard, thereby simulating the sound of running water. The perking sound of a tea pot or coffee pot operates in the same way as the frying sound except there is no white noise.

I claim:

1. An electronic toy comprising: a support having a upper surface; a member adapted to be removably placed on the upper surface and to be supported thereby, said member having magnetic means thereon for creating a magnetic field adjacent to the upper surface when the member is supported thereby; an electronic circuit carried by the support and including an actuatable magnetically responsive device in the field of the magnetic means of the member when the member is on the upper surface, said circuit including a white noise generator having a signal, a speaker for generating sounds, and means coupling the white noise generator to the speaker so that the speaker can generate sounds corresponding to the output signals of the generator, said circuit further including oscillator means responsive to the actuation of the device for producing signals different from the output signals of the white noise generator, and means coupled with said oscillator means for mixing the output signals of the oscillator means and the generator to produce predetermined output sounds at the speaker.

2. A toy as set forth in claim 1, wherein the member has a pair of spaced magnets defining said magnetic means thereon.

3. A toy as set forth in claim 2, wherein the device includes a pair of spaced reed switches carried by the support beneath the upper surface thereof.

4. A toy as set forth in claim 3, wherein one of the reed switches is at the input of the oscillator means and the other reed switch is coupled to the output of the oscillator means.

5. A toy as set forth in claim 1, wherein the support includes a toy stove housing having a simulated burner section, the burner section having a number of different burner parts for defining member-supporting locations, said speaker being below one of said locations.

6. A toy a set forth in claim 5, wherein each of said locations has a magnetically responsive device adjacent thereto and below the upper surface of the support.

7. A toy as set forth in claim 6, wherein is included a second member having magnetic means mounted thereon in a position different from that of the magnetic means of the first-mentioned member.

8. A toy as set forth in claim 1, wherein said circuit includes a timer for delaying the generation of the sounds by said speaker until a predetermined interval after the actuation of the device.

* * * * *